US006170236B1

(12) United States Patent
Whitby et al.

(10) Patent No.: US 6,170,236 B1
(45) Date of Patent: Jan. 9, 2001

(54) PACKAGE WRAPPING METHOD AND MACHINE

(75) Inventors: Michael A. Whitby; Philip Anthony Ratermann, both of Miami, OH (US)

(73) Assignee: Premark FEG L.L.C., Wilmington, DE (US)

( * ) Notice: Under 35 U.S.C. 154(b), the term of this patent shall be extended for 0 days.

(21) Appl. No.: 09/156,535

(22) Filed: Sep. 17, 1998

(51) Int. Cl.[7] ..... B65B 11/00
(52) U.S. Cl. ..... 53/441; 53/556
(58) Field of Search ..... 53/441, 556, 64, 53/66

(56) References Cited

U.S. PATENT DOCUMENTS

| | | | | |
|---|---|---|---|---|
| 4,507,904 | | 4/1985 | Treiber | 53/203 |
| 4,513,558 | | 4/1985 | Treiber | 53/77 |
| 4,520,613 | * | 6/1985 | Claudio | 53/556 |
| 4,674,269 | * | 6/1987 | Denda | 53/556 |
| 4,757,451 | | 7/1988 | Denda | 364/468 |
| 4,944,135 | | 7/1990 | Treiber | 53/502 |
| 4,958,479 | | 9/1990 | Treiber | 53/441 |
| 5,014,489 | | 5/1991 | Terminella et al. | 53/51 |
| 5,115,620 | | 5/1992 | Takamura . | |
| 5,144,787 | | 9/1992 | Whitby et al. | 53/66 |
| 5,383,326 | * | 1/1995 | Dean et al. | 53/556 |
| 5,528,881 | | 6/1996 | Cappi et al. | 53/441 |
| 5,595,042 | | 1/1997 | Cappi et al. | 53/66 |
| 5,653,093 | * | 8/1997 | Delledonne | 53/556 |

FOREIGN PATENT DOCUMENTS

| | | |
|---|---|---|
| 2246450 | 10/1973 | (FR) . |
| WO 00/02777 | 1/2000 | (WO) . |

OTHER PUBLICATIONS

International Search Report for PCT/US99/21803 mailed Apr. 19, 2000.

* cited by examiner

*Primary Examiner*—Eugene Kim
(74) *Attorney, Agent, or Firm*—Thompson Hine & Flory LLP

(57) ABSTRACT

The invention provides an improved package wrapping machine which produces a wrapped product having a good seal and a favorable appearance for packages of varying sizes and shapes. More particularly, these improvements are obtained by utilizing a novel film gripper having sections that are separately disengageable to release tension on lateral sections of the film web during the wrapping of smaller than average packages, thereby preventing unwanted stretching of the film so as to promote a good seal for the packaged goods and avoid the formation of unsightly film tails. Also in a preferred embodiment of the present invention, a novel package pusher is utilized to convey the package to be wrapped from a package infeed location to a registration position on the package wrapping elevator.

12 Claims, 14 Drawing Sheets

PACKAGE WRAPPING METHOD AND MACHINE

BACKGROUND OF THE INVENTION

This invention relates generally to a packaging method and machine for wrapping stretch film around products supported on trays, and more particularly to a package wrapping method and machine employing an improved film gripper having sections which may be selectively disengaged to accommodate wrapping packages of smaller sizes and a package pusher which more consistently deposits a tray to be wrapped at a known registration position on an edge of a package elevator.

A variety of machines are available for wrapping film around trayed products, for example meats and produce in supermarkets, to prepare attractive packages for consumer display. An early example of such a machine is illustrated in U.S. Pat. No. 3,662,513 which discloses using a single length and width of stretchable film for a narrow range of package sizes and heights. These prior art machines would have to be shut down for making several manual adjustments if another range of package sizes was to be wrapped. When wrapping packages in this design, in order to properly wrap the largest or highest package within the range, excess and therefore wasted film results for the smaller sizes. Excess film creates unsightly clumps and tails of film on the bottom of such smaller packages, and this in turn results in poor bottom seals and leaking packages.

To overcome the problems created by using a single fixed length stretchable film sheet for wrapping several package sizes, film wrapping machines have been developed which permit the automatic selection of a variety of film lengths to accommodate varying package sizes. An example of an automatic film length selection mechanism for a film wrapping machine is disclosed in U.S. Pat. No. 4,510,731. In this patent, the automatically measured length of a package controls the stroke distance of a reciprocable film gripper to draw the appropriate length of film from the supply roll for wrapping the particular package. However, the stroke adjusting mechanism is complicated, requiring special mechanical linkage, an adjusting control motor, sensing switches and control electronics to automatically vary the lengths of film drawn into the machine. Accordingly, while the adjustable mechanism was a substantial improvement over the fixed film length wrapping of then-existing prior art, it entailed greater initial cost and maintenance expense.

Another film sheet sizing arrangement is disclosed in French Patent Publication No. 2,410,601 wherein a film sheet is held across the path of an obliquely raised elevator. In the French publication, a package is placed on the elevator and obliquely raised into and through a plane defined by the film to thereby draw any additional film which is required by the height of the package from a continuous source of the film. The obliquely raised elevator comprises a surface which is sequentially replaced by a film underfolder to thereby support the package and permit the elevator to be lowered for the next package to be wrapped. Film length is determined by severing the sheet only after the underfolder has been entirely inserted under the package to position the severed film end at a film holding mechanism for the next package. The leading and trailing edges of the film are brought together to form an overlapping sleeve arrangement for wrapping the package.

Another film sheet sizing arrangement is disclosed in U.S. Pat. No. 4,813,211, issued Mar. 21, 1989, entitled "Package Wrapping Method and Machine," to Treiber and assigned to the same assignee as the present application. According to this patent, the length of each package is measured during its travel to a wrap station. A fixed length of film is initially drawn by a film gripper into the wrapping machine to the same stop or end position for all package sizes. The package is placed on an elevator and is raised into and through a plane defined by the film, thereby permitting the package height to draw a first film addition from the source if the height is above a certain minimum. A rear underfolder bar is moved horizontally into contact with the film at a location between the package and the film source to commence film underfolding beneath the package. As this takes place, a heated cut-off wire is passed through the film vertically, behind the bar. The timing of the wire passage is such as to provide the proper film length in accordance with the initial measured length of the package. The net result is to provide an initial fixed film length for all package sizes, a first inherent additional film draw for high packages and a second measured film length by timing an on-the-fly sheet cut to occur after the package is fully elevated and has pulled all the extra film needed. The first additional film draw is made somewhat similarly to that of the aforementioned '601 French Publication. However, a problem encountered in the '211 patent system occurs when using heavy gauge film or using foam trays with weak edges. Under such circumstances the film tension force applied to the foam trays at their trailing edges caused trays to break or crack on occasion during underfolding. That requires a rewrap and results in lost production time. In addition, because the rear underfolder of the '211 patent is also used to advance the tail of the film for obtaining the second featured length, it is necessary to use a cut-off or severing means capable of effectively cutting "on-the-fly" and passing through the moving film rapidly while it is under tension. Not only is a mechanical knife felt unsuitable for cutting moving film, but an on-the-fly cut requires immediate braking of the film and roll behind the cut, in order to properly present the cut end to film grippers for the next sheet of film to be pulled.

Yet another patent, U.S. Pat. No. 5,144,787 to Whitby et al., the inventor of the present invention and assigned to the assignee of the present invention, discloses a package wrapping method and machine with improved features for paying out the required amount of stretch wrap from the supply roll for each individual package. In the '787 patent, a tray containing goods to be wrapped is placed on an infeed conveyor where one of a plurality of package pushers on a continuous loop receives the package and carries it to an elevator. The pusher is braked just short of the elevator depositing the package near the front edge of the elevator, and the pusher is maintained in this position until the elevator is raised sufficiently to allow clearance for the pusher as it continues on the loop. Simultaneously, after film from an appropriate supply roll is chosen based on a premeasured package width, a fixed amount of stretch film is drawn horizontally from the selected supply by a gripper over the elevator opening. Next, the elevator is raised through the film, and the package draws a first additional length of film from the roll based on the height of the package. Then, if required, a second additional length of film is drawn from the roll by a vertically moving horizontal bar located adjacent the roll, based on the premeasured package length. Finally, the film is cut and folded around the package and the package is transported from the machine by a heated belt which seals the overlapping edges of the film under the tray.

While the above-identified inventions solve some of the problems associated with wrapping packages of varying sizes, several other problems have not been sufficiently addressed prior to the wrapping machine of the present invention. For one, due to the precision required for the wrapping procedure, it is essential for the package to be properly positioned at all times during the wrapping process. Since the package's dimensions are measured at the beginning of the process and the location of the pusher is known, if no other significant variables arc introduced, the location of the package at any point in time can be determined. However, the braking of the pusher as it approaches the elevator as described in the '787 patent affects the final location of the package in that the package has a tendency to slide on the elevator due to the momentum produced by the pusher. The variables that contribute to this sliding effect can be difficult to account for and include the speed of the pusher, the weight of the package, and the coefficient of friction of the tray, among other things. The consequences of not having the package consistently located at the same position on the elevator includes finished packages that are not adequately sealed, as well as possible package jams which may lead to lost product, equipment failures and equipment down time.

Furthermore, another problem not effectively addressed by prior art wrapping machines involves the production of excess wrapping material in the form of unsightly "tails" which extend from the bottom of smaller wrapped packages. The reason for this occurrence is that the lateral sections of the film held by the gripper during the folding process become stretched due to the tension placed on the film. With larger packages, this poses very few problems since the additional film can be neatly tucked and sealed under the tray. However, for a very small package, even when the narrowest roll of film is selected from the roll supplies, the width of the film is still sufficiently greater than the width of the package that it cannot all be folded under the package, especially given the degree that the film is stretched during the folding process. Not only do these tails detract from the overall appearance of the wrapped package, they also prevent the creation of a good seal around the wrapped product, threatening the integrity of the goods therein. While it is conceivable that these tails could be greatly reduced by offering a larger selection of varying width stretch film supply rolls for the gripper, equipment costs and design complexity, as well as other design constraints, make this solution undesirable.

Accordingly, there exists a need for an improved package wrapping machine which consistently produces a wrapped product having a good seal and a favorable appearance for packages of various sizes, which is of relatively simple design, and which is efficient and reliable in operation. Preferably, these improvements will be obtained by a wrapping machine which locates the package to be wrapped in a predetermined position on the elevator, which eliminates package "slide" on the elevator, which alleviates some of the stretching of the film during the folding process for smaller packages thereby diminishing the size of the tails protruding from the bottom of the wrapped package, and which is extremely user-friendly requiring minimal operator inputted information or skills. Most preferably, portions of the improved design features will be retrofittable to prior art machines thereby allowing the new improvements to be implemented in old machines without the need for purchasing all new equipment.

SUMMARY OF THE INVENTION

In accordance with a preferred embodiment of the present invention, a continuous film supply is selected from a choice of film supply of different widths, according to the measured width of the package to be wrapped. The free end of the selected stretch film is then gripped by a gripper and drawn over the elevator to a defined position beyond the registration position. In a preferred form of the present invention, when the premeasured width of the package to be wrapped is relatively small, the gripper includes two outer sections which may be separately opened, thereby releasing tension on the outer lateral portion of the film web, preventing further stretching of the film by the side grippers and during the folding process. Rear and side underfolders are then actuated to fold the lateral and trailing edges of the film under the package. The side grippers are opened substantially upon engagement of the film by the side underfolders. The package is finally ejected by pushing it from the wrapping station to fold the originally gripped free end of film under the package and the originally gripped end is released as the package is ejected from the wrapping station.

In accordance with another aspect of the present invention, a machine for wrapping packages in stretch film comprises an infeed conveyor for loading a package to be wrapped for pick-up by a package pusher. The package pusher, preferably coupled to a continuous drive loop, engages said package pushing it through a pair of resiliently biased pivotally mounted swing arms which are linked to microswitches for determining the package dimensions, although this information may be manually inputted by the operator into the controls by conventional knobs or buttons if desired. A preferred package pusher will preferably aggressively engage the side of the package so that the pusher will not slide underneath the package. Preferably, the swing arms also operate to help center the package on the package pusher. Next, the package pusher conveys the package of measured dimensions to an elevator of a wrapping station and locates the package at a pre-determined registration position, preferably on the side of the elevator closest to the operator, and resets for loading of another package. A preferred pusher has a rounded profile to avoid catching an edge of the package once the package is deposited at the registration position on the elevator.

Thus it is one object of the invention to provide, in the type of package wrapping machine wherein a fixed length of film is initially pulled from a supply roll to a predetermined position, an improved apparatus and technique which consistently produces a wrapped product having a good seal and a favorable appearance for packages of various sizes and which is of relatively efficient and reliable operation.

Another object of the invention is to provide a package pusher which can pick up packages of varying sizes from a load-in area and repeatably center and transport the packages to a registration position on the elevator notwithstanding variations in weight, size or construction of the packages. It is a further object of the invention to provide a film gripper which alleviates some stretching of the film web during the folding process based on a premeasured width of the package. Finally, it is an object of the invention to provide these improvements in a way that may be retrofitted to existing wrapping machines.

DETAILED DESCRIPTION

Figure 1:
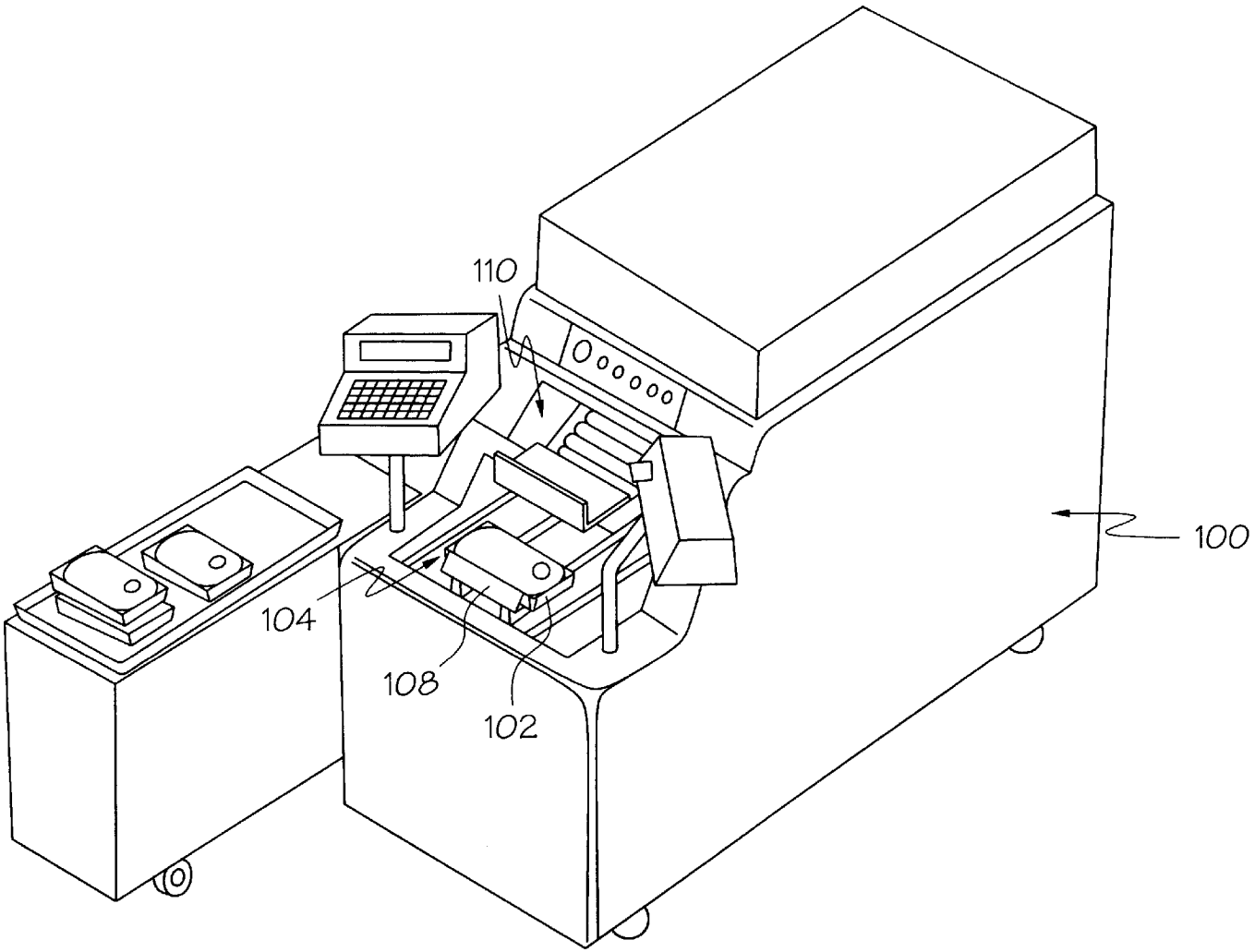
FIG. 1 is a perspective view of a preferred embodiment of a package wrapping machine of the present invention.
Figure 2:
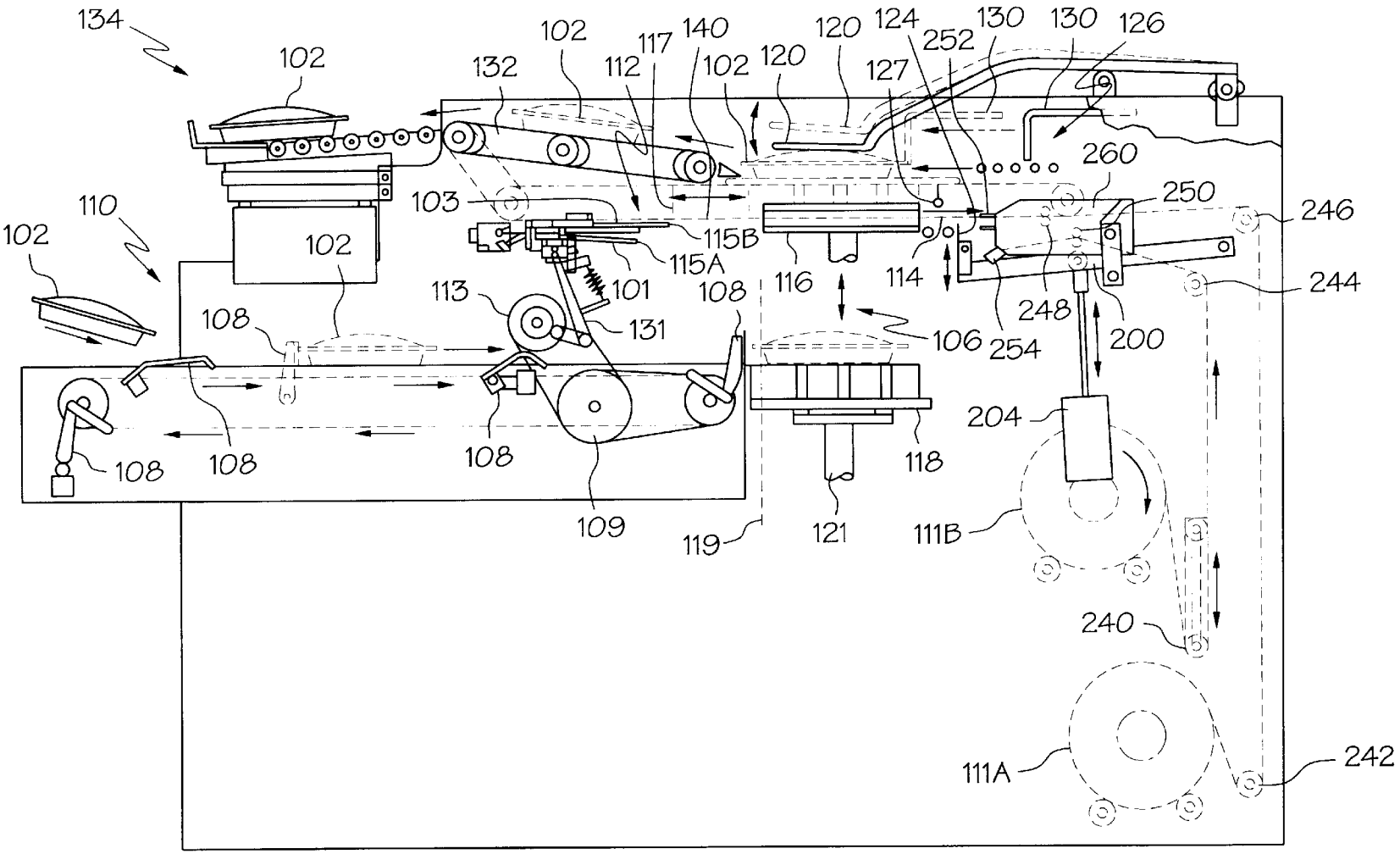
FIG. 2 is a detail side schematic view of the package wrapping machine of FIG. 1.

The general operation of a package wrapping and weighing machine 100 incorporating the present invention, as shown in FIGS. 1 and 2, is as follows. A package 102 comprising, for example, meat, produce or other food product is placed upon a tray to be wrapped in stretchable heat-sealable film, weighed and labeled for attractive display. The package 102 is placed in a package infeed station 104 from which it is conveyed to a package wrapping station 106 by an intermittently-operated first infeed conveyor means which comprises package pushers 108 and is powered by a motor 109, such as a DC brushless motor.

Figure 6:
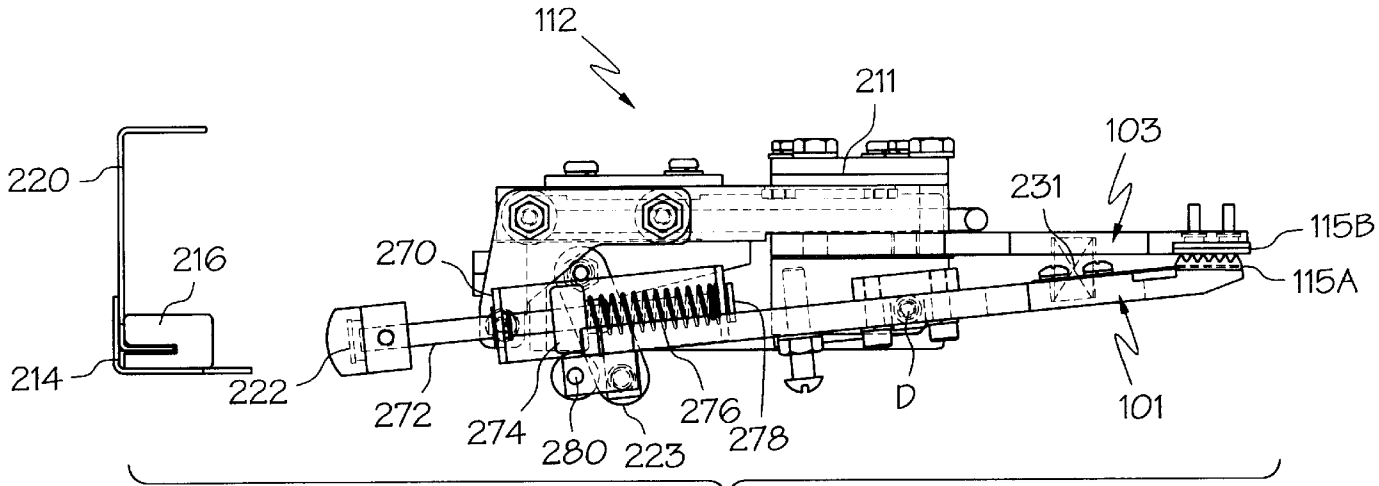
FIG. 6 is a side elevational view of the gripper assembly of FIG. 3 after actuation of the solenoid.
Figure 7:
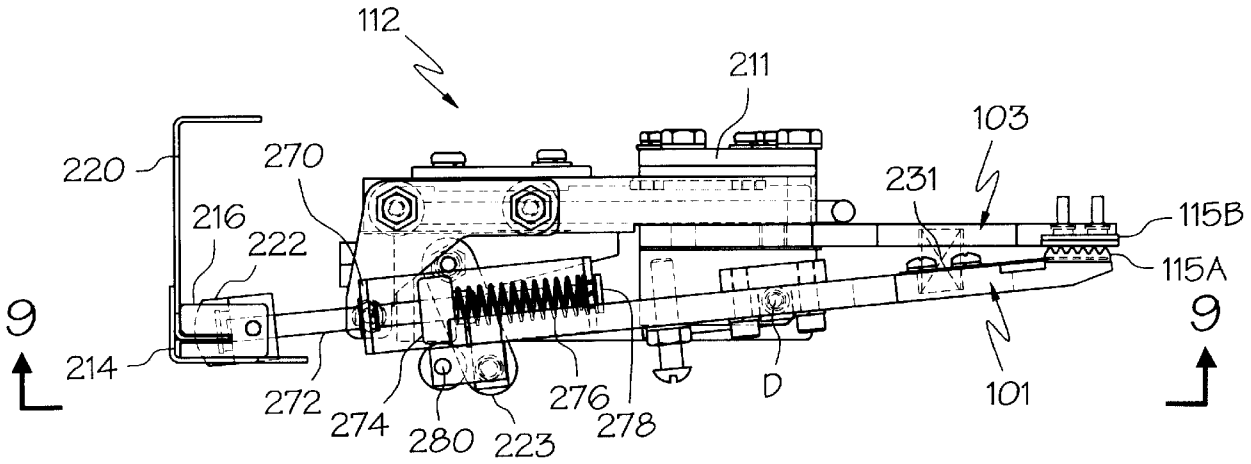
FIG. 7 is a side elevational view of the gripper assembly of FIG. 3 prior to the uncoupling of gripper lower jaw lateral elements.
Figure 13:
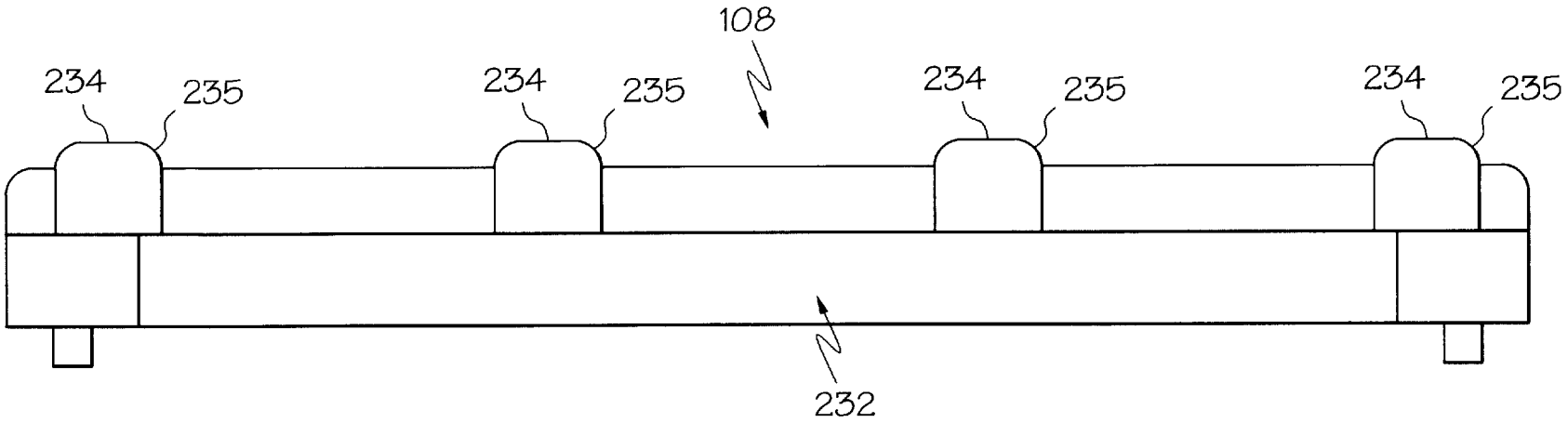
FIG. 13 is a top plan view of a package pusher for use in a package pusher assembly of FIG. 11.
Figure 14:
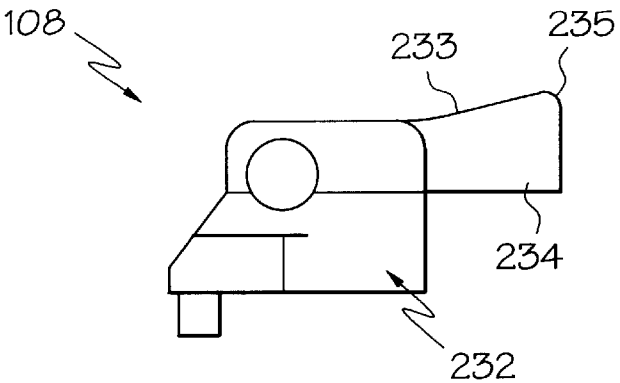
FIG. 14 is a side elevational view of the package pusher of FIG. 13.
Figure 15:
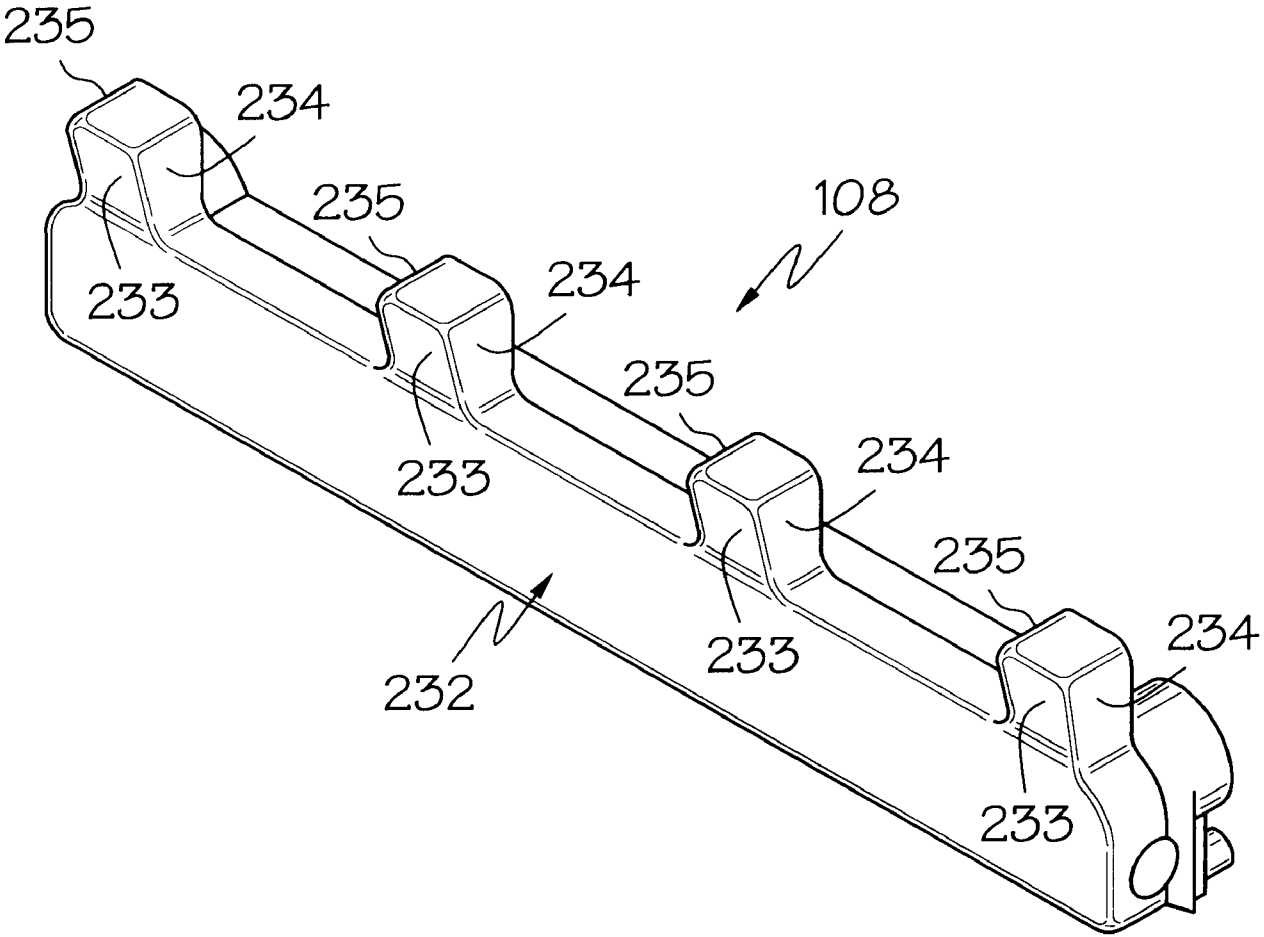
FIG. 15 is a side perspective view of the package pusher of FIG. 13.

The package 102 is conveyed along a package entryway 110 which includes the package infeed station 104 and extends to the package wrapping station 106. As best shown in FIGS. 6 and 7, a package pusher 108 of the present invention is mounted on a continuous loop drive 230 which is coupled to motor 109. As shown in FIGS. 13–15, the package pusher 108 includes a base portion 232 and fingers 234. Preferably, the fingers 234 are mounted on the base portion 232 at an angle or have an angled face 233 so as to engage the package to be wrapped at an appropriate "attack" angle, thereby preventing the pusher 108 from sliding under the package. Fingers 234 are positioned appropriately to intermesh with spaces 236 in elevator platform 118 so that the package pusher may continue around axle 240 without contacting the elevator platform 118 thus placing package 102 at registration position 119. Also in a preferred embodiment, the upper portion of the fingers 234 of the pusher 108 are rounded 235 in order to keep the fingers 234 from catching or "hooking" an edge of the package as the pusher 108 continues around axle 240 after depositing the package at the registration position 119. Thus the variables present in prior packaging machines, namely the inconsistent positioning of the package 102 on the elevator platform 118 due to the "sliding" of the package caused by the braking required for the prior art package pusher, is not encountered in the wrapping machine of the present invention. Since the package pusher 108 of the present invention may continue around axle 240 along continuous loop drive 230 without having to brake to wait for the elevator platform 118 to be moved, the package 102 is consistently placed at registration position 119.

As the package 102 is conveyed along the package entryway 110 by one of the package pushers 108, a horizontally-extending film gripper 112 is moved to a fixed film end pick-up position 114 by the trolley bar 211, which is mounted on chain drive 140. The chain drive 140 is attached to a lever arm 131 of the gripper cam 113, which is also powered by motor 109. Thus, the gripper 112 is reciprocable between a defined stop position 117 and a fixed film end pick-up position 114 where the free end of a continuous source or roll 111A or 111B can bc grasped. The film is gripped by the gripper 112 and drawn into the machine 100 by retraction of the gripper 112 to the left to a fixed film draw or defined stop position 117, in which the gripper 112 is shown in FIGS. 2, 3, 8, and 10 regardless of the premeasured size of the package 102. Accordingly, the film initially drawn by the film gripper 112 is of a fixed length, defined by the travel distance of the gripper 112, for all sizes of packages.

As the package 102 enters the machine 100, the width and length of the package 102 are measured. Width and length may be measured as disclosed in U.S. Pat. No. 4,813,211. It should be noted that, in the illustrated embodiment of the package wrapping and weighing machine 100, the width of a package refers to the package dimension across the machine and the length refers to the package dimension lengthwise of the machine. The length measurement is used to control the amount of advancement of the trailing edge of the film prior to its being cut at a cut line by a serrated knife 124, in order to have the length of film coincide with the requirements to fully cover the bottom of a given package in the lengthwise direction without having excess film.

The film initially drawn into the machine 100 is held in tension by the film gripper 112 and is taken by side grippers 116 which engage opposite sides of the film and stretch it outwardly toward the sides of the machine 100 in known fashion. The package 102 is positioned on a package elevator 118 at a first level at a package registration edge 119. An elevator support member 121 vertically moves elevator 118 with the package 102 through the plane of the prestretched film to an upper second level wherein the elevated package is shown in phantom in contact with a pad of a resiliently biased hold down arm 120, which operates to keep the package from moving during the folding process.

As previously noted, film drawn by the gripper 112 is initially a uniform length for all packages, regardless of their individual dimensions, since the film gripper 112 moves from the film end pick-up position 114 to the same defined stop position 117 for all packages. However, additional film can be drawn from one or the other of two continuous rolls 111A or 111B during the package wrapping process. A first addition to the film drawn by the gripper 112 is drawn as the package is elevated through the plane of the prestretched film since it is being held by the film gripper 112 and the side grippers 116. The first additional amount of film drawn, if any, varies with the height of the package. Hence, the machine is arranged so that a low package draws no additional film during elevation, while a high package may draw considerable additional film in known fashion.

A second additional amount of film, if any, is incrementally drawn by a vertically moving horizontal bar or rod 127. Operation of the vertically moving horizontal bar is described in detail in the aforementioned U.S. Pat. No. 5,144,787 to Whitby et al. Broadly speaking, the mechanism for operating bar 127 can be said to be a film tail advancing means. In the illustrated embodiment, the bar may be kept stationary for a short package length, in which case the tail is not advanced at all, or the unit may be selectively operated to move the bar to advance the tail toward the package an additional distance to increase the film length. The number and dimensions of the added lengths can be varied with the machine design according to the range of packages to be wrapped.

Figure 3:
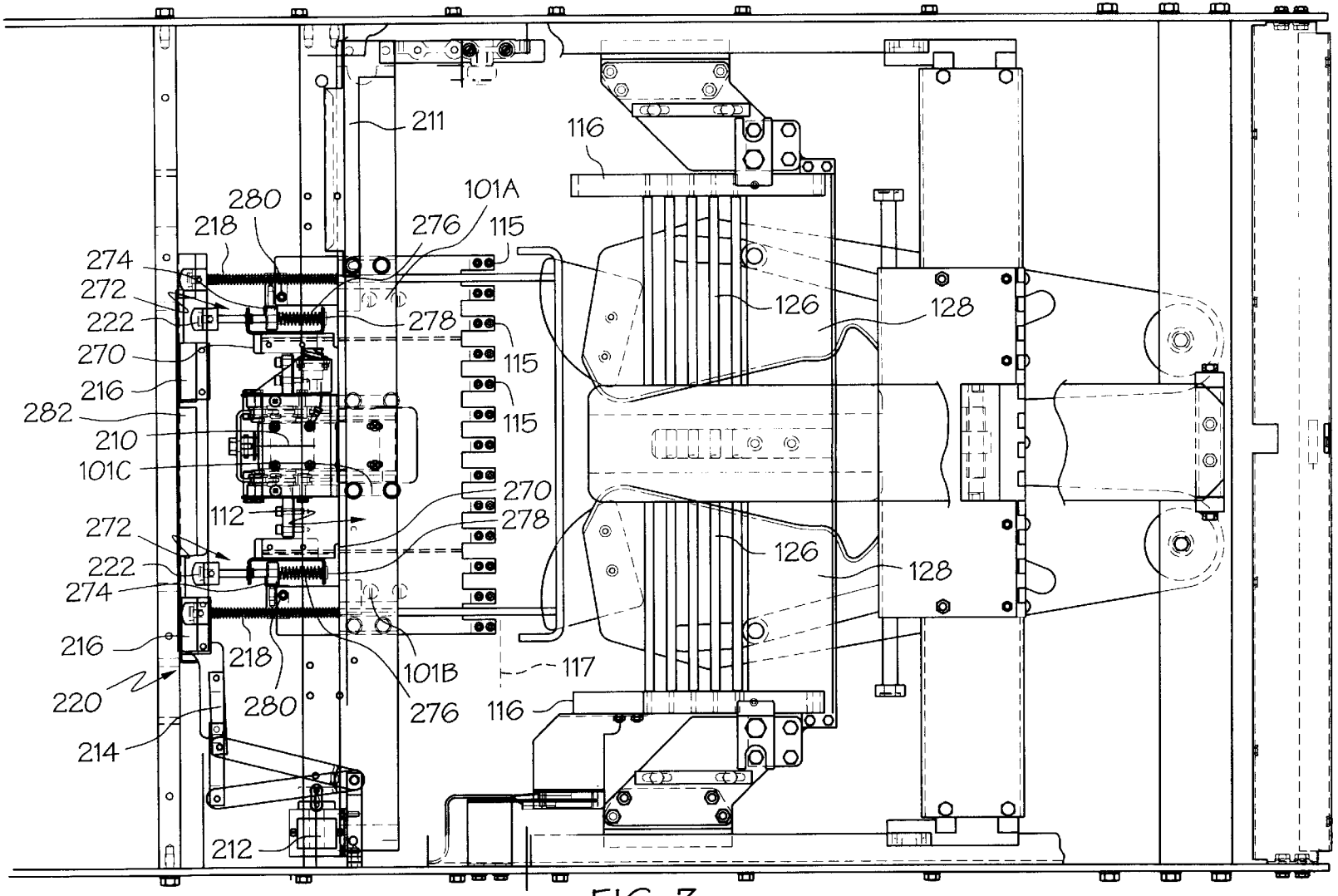
FIG. 3 is an overhead plan view of a preferred embodiment of a gripper assembly for use in the package wrapping machine of FIG. 1.
Figure 4:
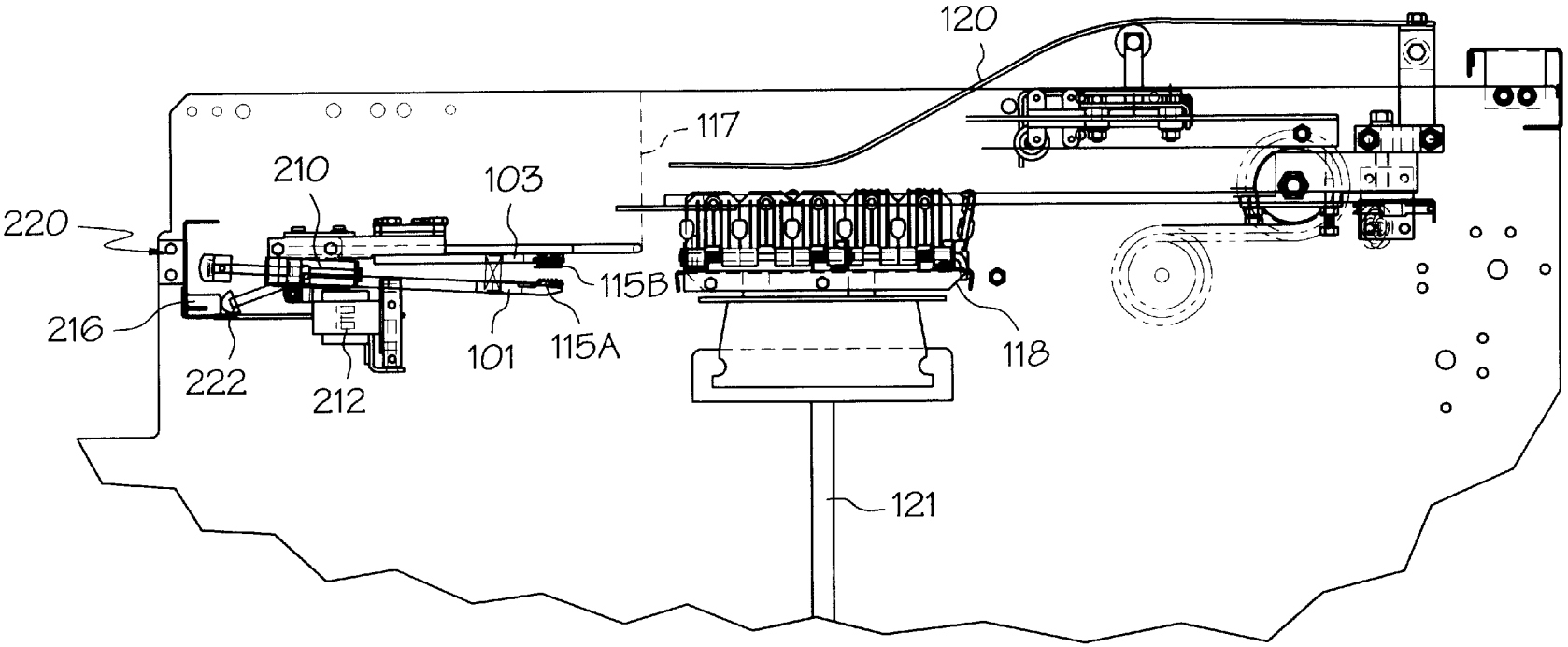
FIG. 4 is a side elevational view of the gripper assembly of FIG. 3.
Figure 5:
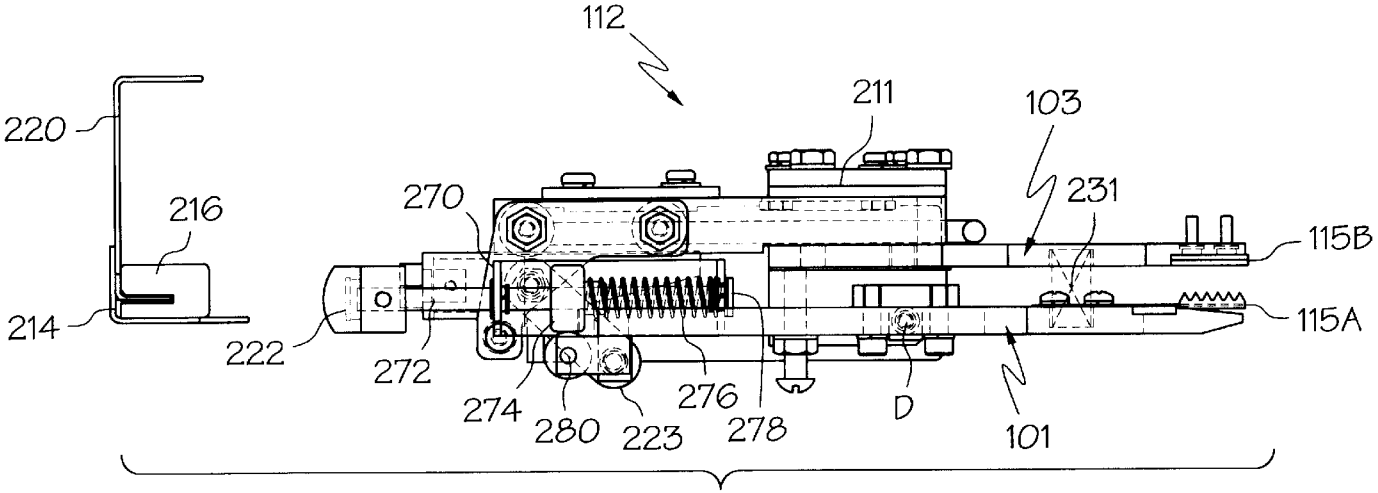
FIG. 5 is a side elevational view of the gripper assembly of FIG. 3 prior to actuation of the solenoid.
Figure 9:
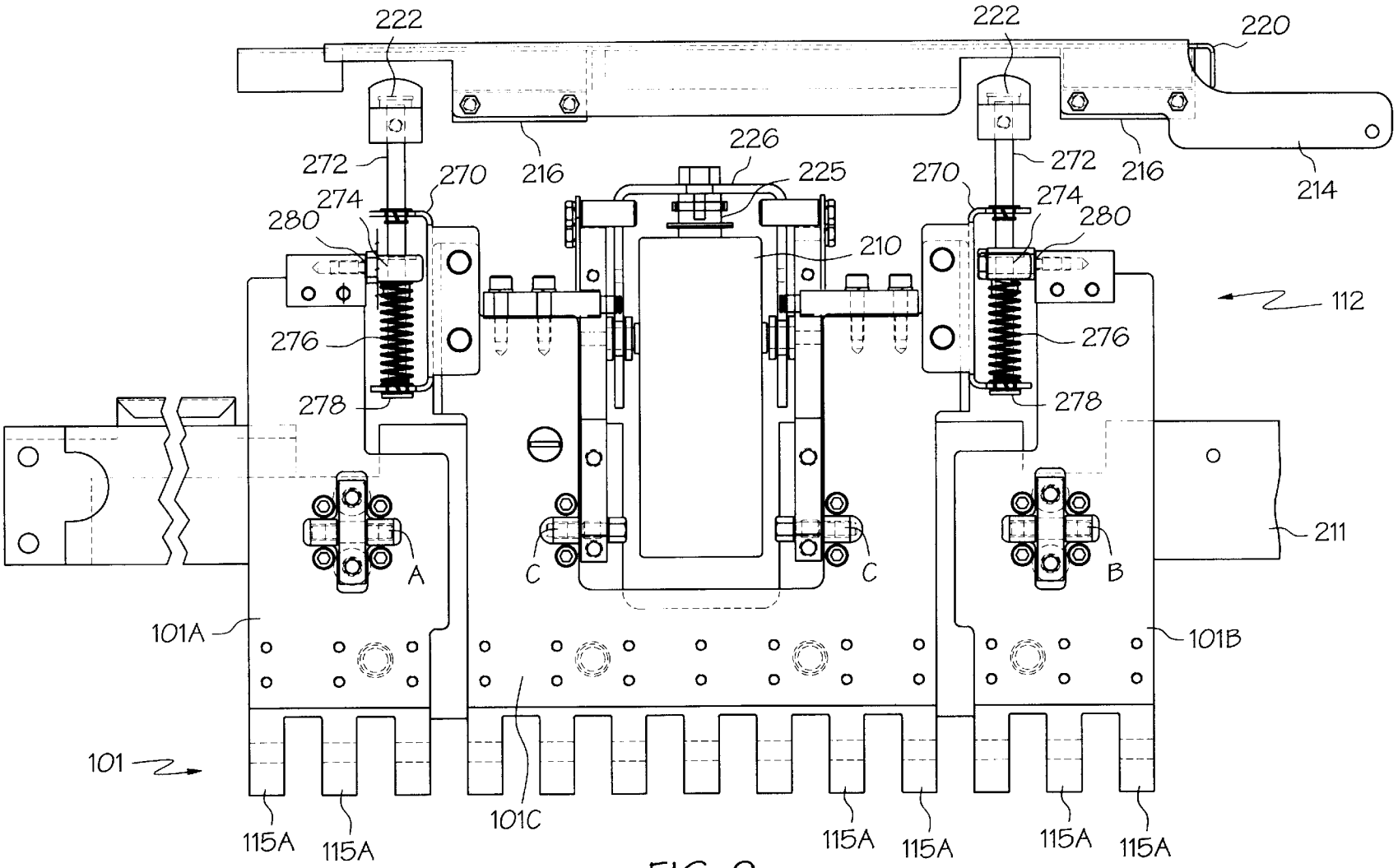
FIG. 9 is a plan view of the underside of the gripper assembly of FIG. 7 taken at line 9—9.
Figure 10:
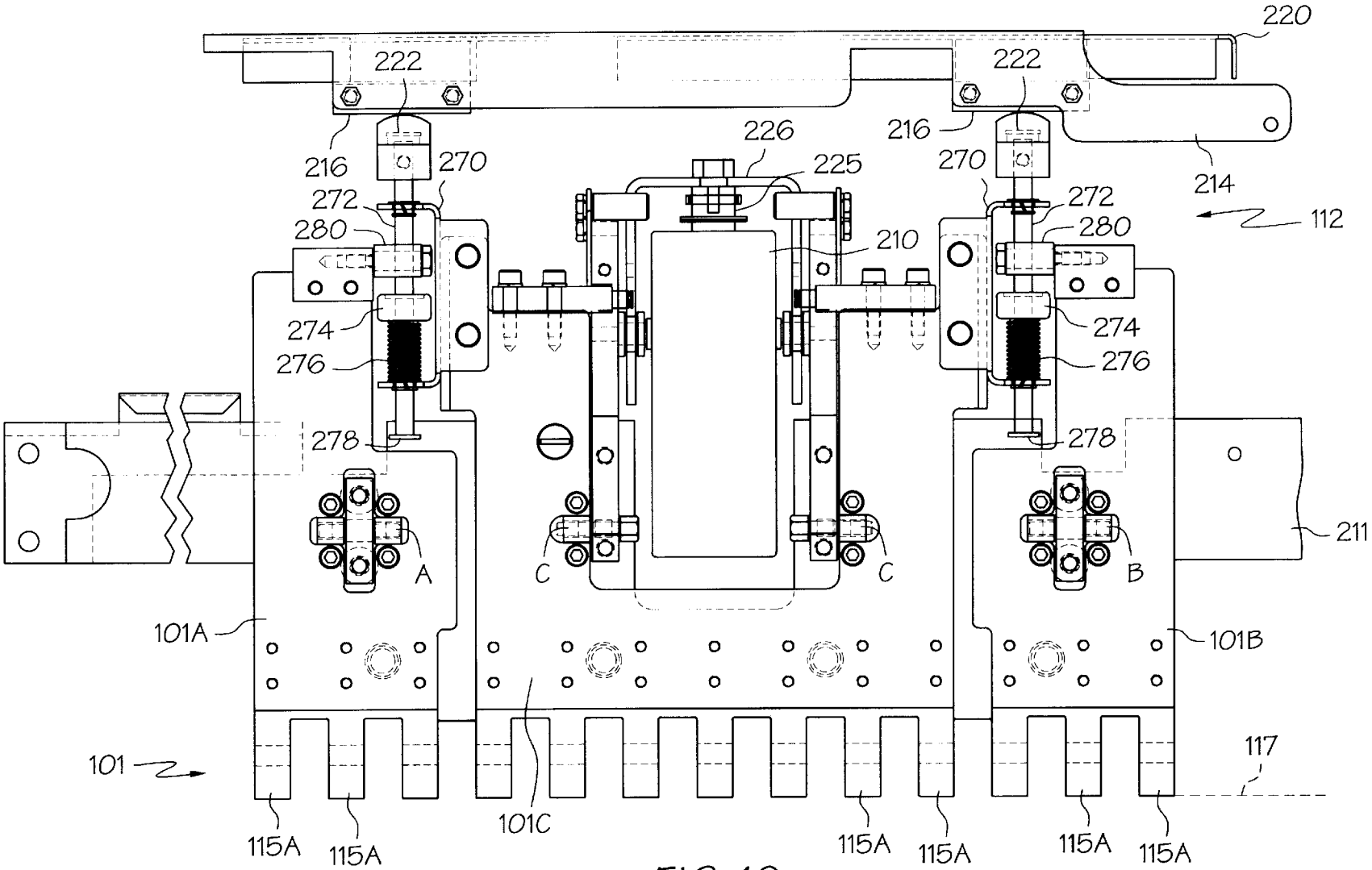
FIG. 10 is a plan view of the underside of the gripper assembly of FIG. 8 taken at line 10—10.
Figure 11:
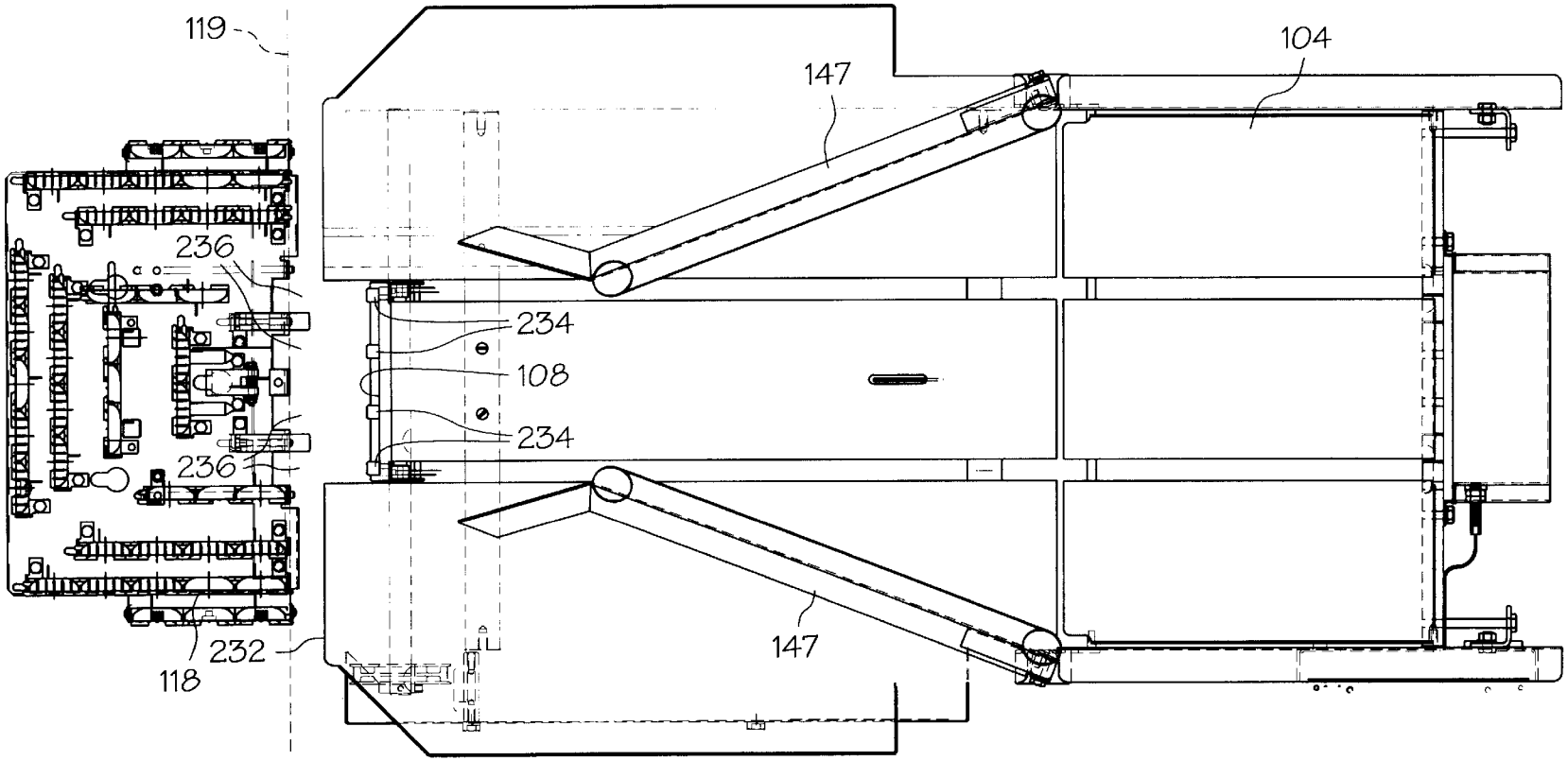
FIG. 11 is an overhead plan view of a preferred embodiment of a package pusher assembly for use in the package wrapping machine of FIG. 1.
Figure 12:
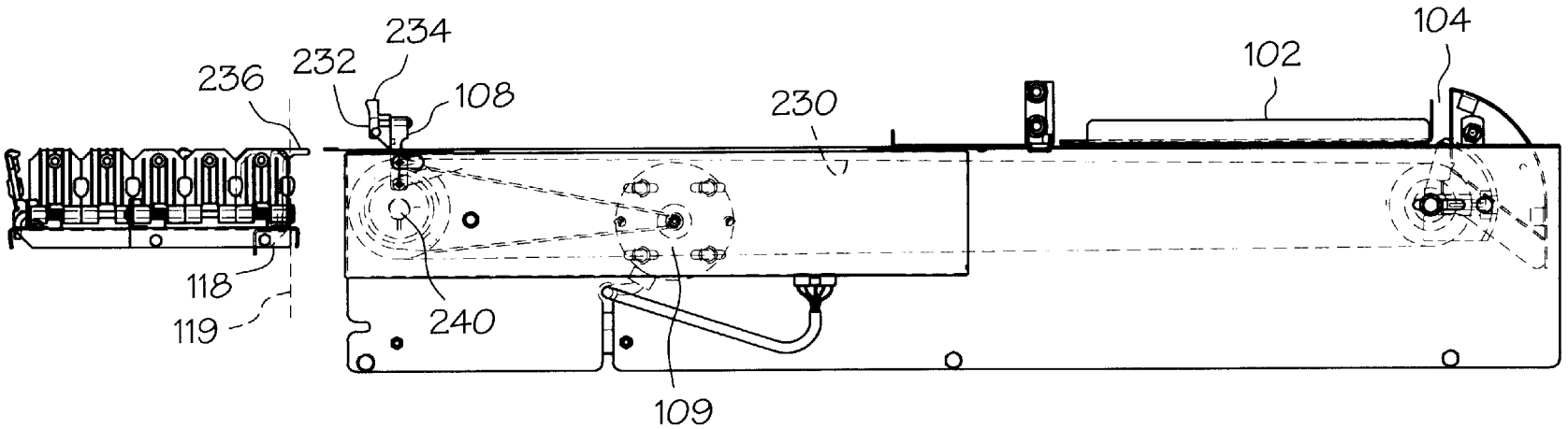
FIG. 12 is a side elevational view of the package pusher assembly of FIG. 11.

The width measurement, which is taken by conventional laterally-spaced switches 147 as shown in FIG. 11, is used for several purposes. For one, it determines which of the pair of different-width film rolls 111A or 111B has its free end presented to be received by the gripper 112. As discussed in detail in U.S. Pat. No. 4,513,558 to Treiber, and shown best in FIG. 2, this procedure is accomplished by feeding film from rolls 111A and 111B under the tensioning rollers 240, 242, up and over guide rollers 244, 246, and into the selective film feeding apparatus 260 shown at the film end pick-up position 114. The guide rollers 244, 246 include one-way clutches to be freely rotatable in the clockwise direction. The rollers 244, 246 thus permit the film to be freely drawn into the machine through the film feeding apparatus apparatus 260, but retard its tendency to be withdrawn from the machine by the tensioning rollers 240, 242. The film feeding apparatus 260 is pivotally mounted to the machine structure and coupled to a solenoid (not shown) so that, depending on the film supply that is selected, the feeding apparatus 260 may be pivoted to align the appropriate set of film feeding jaws 252, 254 with the film end pick-up position 114. The film feeding jaws 252, 254 are associated with pinch rollers 248, 250, respectively, with the film being threaded between the pinch rollers 248, 250 and the jaws 252, 254 so that the film may be gripped by the gripper 112 at the film end pick-up position 114. The film feeding jaws 252, 254 have teeth (not shown) on their leading edges that are positioned to mate with corresponding teeth 115 on the gripper 112, as shown in FIGS. 3, 9, and 10 when the gripper 112 is moved to a film end pick-up position 114. Thus, with the film extending to the front edge of the film feeding jaws 252, 254, the teeth of the film gripper 115 can engage the film between the teeth on the leading edge of one of the film feeding jaws 252, 254.

The width measurement also serves the purpose of determining whether or not individual lateral jaw elements 101A, 101B of gripper 112, as best shown in FIGS. 3, 9 and 10, will need to be disengaged to prevent excess stretching of the lateral portions of the film during the folding process. In a preferred embodiment, the gripper 112 includes a lower jaw 101 and an upper jaw 103 which are pivotally coupled to one another for grasping a free end of continuous source roll 111A or 111B as described above. The lower jaw 101 is split into three elements, two individually releasable lateral elements 101A, 101B, and a primary central element 101C. While three separate elements are utilized in the preferred embodiment, one of ordinary skill in the art would realize that other embodiments of the gripper 112 could include 5, 7, or any number of elements if desired, all of which are considered within the scope of the present invention. All three elements 101A, 101B, and 101C of the lower jaw 101 are pivotally mounted to the upper jaw 103 individually at separate pivot points A, B, C, as best seen in FIGS. 9 and 10, although they all share a common pivot axis D, as best seen in FIGS. 5–8. Thus, all three elements may be coupled together and pivoted in unison. This coupling may be accomplished in any number of ways including using a translatable catch or an interlocking finger device, however in the preferred embodiment a resiliently biased plunger rod mechanism having a retainer positioned thereon is used.

As best shown in FIGS. 5–8, the lower jaw 101 pivots with respect to the fixed upper jaw 103 which is bolted to the underside of the trolley bar 211. The trolley bar 211 carries the entire gripper assembly between the defined stop position 117 and the film end pick-up position 114. The ends of the trolley bar 211 are attached to a chain drive 140 and are seated in a channel (not shown) which restricts the trolley bar 211, and thus the gripper 112, to relative lateral movement and helps support the weight of the trolley bar 211/gripper 112 assembly. A gripper cam 113 is coupled to motor 109 and has a lever arm 131 which is attached to and reciprocatingly propels the chain drive 140. Also bolted to the to the underside of the trolley bar 211 is the gripper solenoid 210 which controls the opening and closing of the pivotable lower jaw 101. The solenoid piston 225 is coupled to a gripper bracket 226 by a bracket lever arm 223 which is pivotally coupled to the back portion of the central element 101C behind the jaw main pivot point C of the lower jaw 101. The lever arm 223 is attached to the central element 101C at a 45 degree angle so that when the solenoid 210 is actuated, the solenoid piston 225 extends from the solenoid body 210, urging the lever arm 223 back and down and thus the back portion of the central element 101C downward. The downward action on the back portion of the central element 101C of the lower jaw 101 acts to force the front portion of the lower jaw upwards, closing the teeth 115A of the lower jaw 101 against the teeth 115B of the upper jaw 103 which are equipped with rubber pads for gripping the film. In this manner, the gripper 112 is able to grasp a free end of film at the film end pick-up position 114.

Two plunger brackets 270 are attached to the back portion of the primary element 101C of the gripper lower jaw 101. The plunger brackets 270 have bores protruding therethrough which support plunger rods 272 while allowing relative rotational and translational movement of the rods 272. Each plunger rod includes a head portion 222 on the trailing end, a retainer 274, and is encircled by a spring 276. A stop 278 is formed on the leading end of each plunger rod 272 which retains the rod 272 in the bracket 270. The spring 276 is positioned between the end of the bracket 270 and the retainer 274, which is fixedly attached to the plunger rod 272, such that the stop 278 is urged against the bracket 270 by the spring 276. Each lateral element 101A, 101B of lower jaw 101 has a finger 280 which extends towards the primary element 101 C. The fingers 280 are positioned to engage the bottom surface of retainers 274 on the plunger rods 272, thus causing all three elements 101A, 101B, 101C to pivot in unison when solenoid 210 is actuated. However, if a force sufficient to overcome the force of the springs 276 is placed on the heads 222 of the plunger rods 272, the retainers 274 are displaced, thus disengaging the fingers 280 on the lateral elements 101A, 101B. Lateral elements 101A, 101B are then uncoupled and able to move independently of the primary element 101C, and, due to the force of return springs 231 between upper jaw 103 and lower jaw 101, pivot downwardly away from upper jaw 103 releasing any film that may be gripped between the teeth 115A of the lateral elements 101A, 101B and the teeth 115B of the upper jaw 103.

As seen in FIGS. 9 and 10, a slide bracket 220 for slidably receiving a slide 214 is mounted behind the predefined stop position 117 of the gripper 112. This assembly controls whether the plunger rods 272 uncouple the lateral elements 101A, 101B from the central element 101C of the lower jaw 101. The slide 214 is coupled to a slide solenoid 212, as shown in FIG. 3, and has two plunger bumpers 216 mounted thereon. As seen in FIG. 3, resilient member 282 is attached between the slide 214 and the slide bracket 220 to resiliently bias the slide 214 to a first, "closed" position absent an intervening force from the slide solenoid 212. The plunger bumpers 216 are positioned on the slide 214 so that when the slide 214 is in the first, "closed" position, caused by the force of resilient member 282 against the slide 214 absent an intervening force from the solenoid 212, the plunger bumpers 216 block the rearward travel of plunger rod heads 222, thus causing uncoupling of lateral elements 101A, 101B of lower jaw 101 from primary element 101C, as discussed above. The slide 214 and slide bracket 220 are shaped so that when the slide 214 is moved to a second, "open" position by actuation of the solenoid 212, rearward travel of plunger rod heads 222 is unimpeded.

Figure 8:
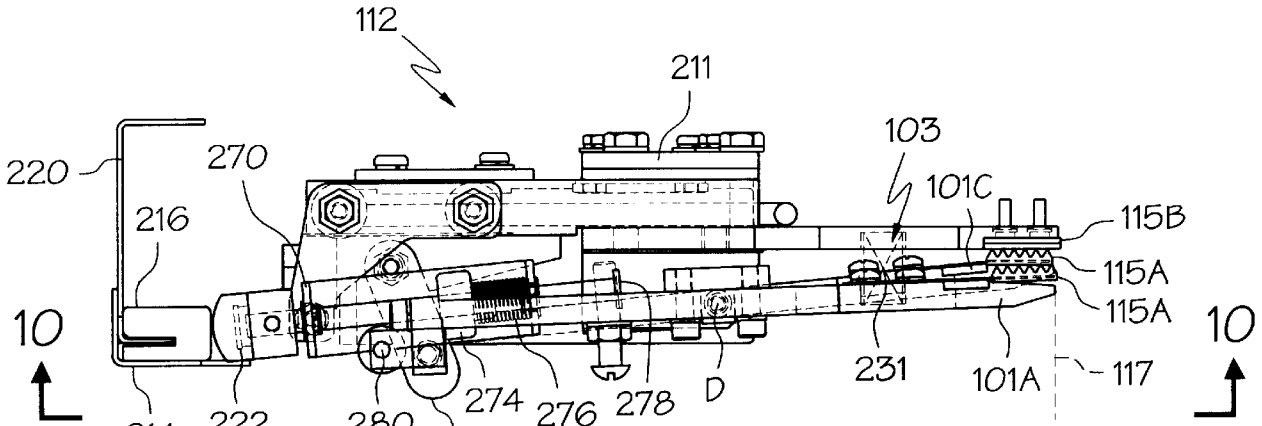
FIG. 8 is a side elevational view of the gripper assembly of FIG. 3 after the uncoupling of gripper lower jaw lateral elements.
Figure 16:
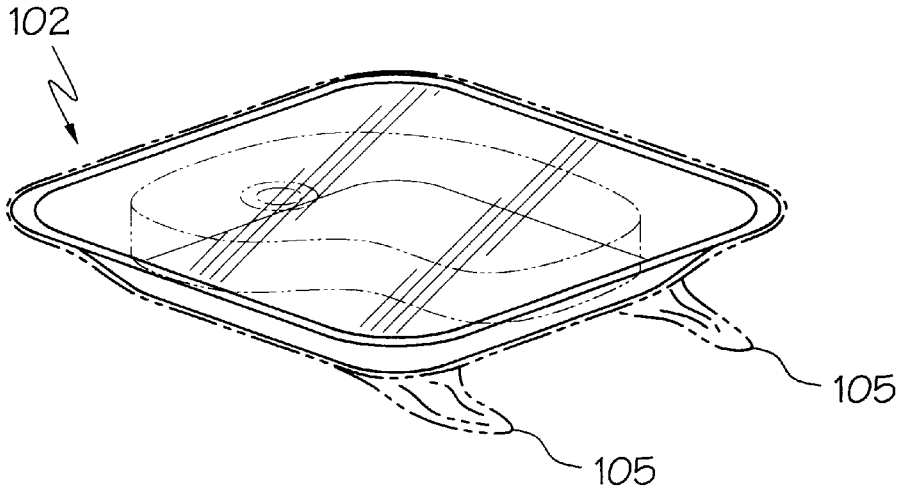
FIG. 16 PRIOR ART
FIG. 16 is a perspective view of a package wrapped using a prior art package wrapping machine.
Figure 17:
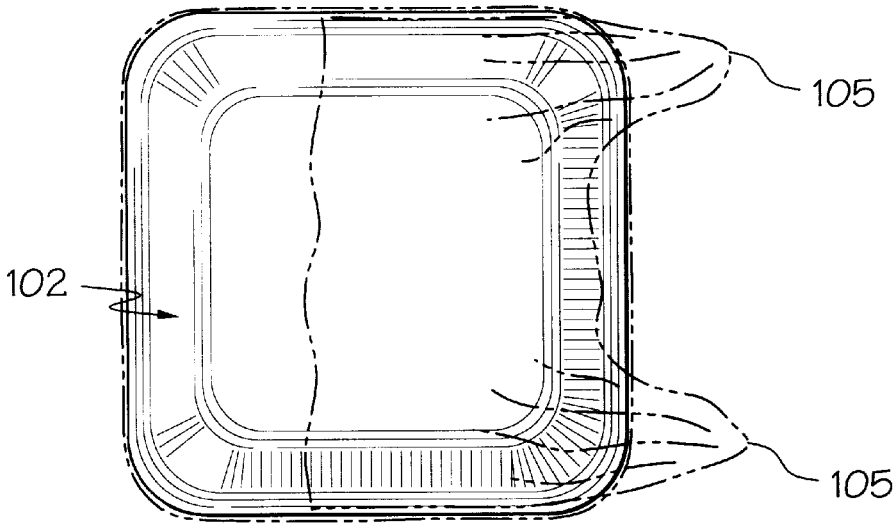
FIG. 17 PRIOR ART
FIG. 17 is a plan view of the bottom of the prior art package of FIG. 16.
Figure 18:
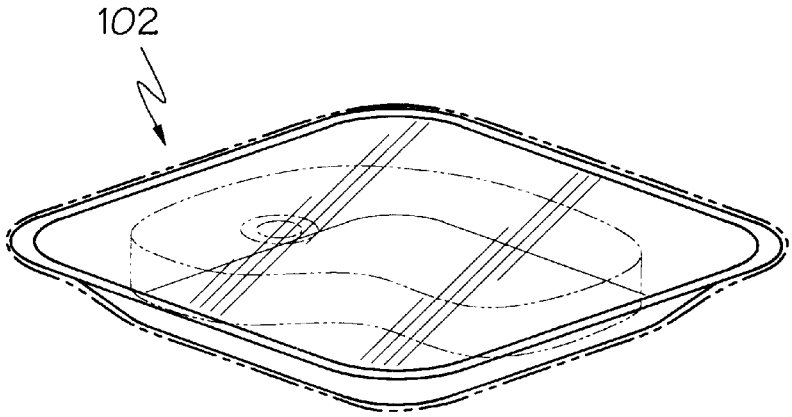
FIG. 18 is a perspective view of a package wrapped using the package wrapping machine of FIG. 1.
Figure 19:
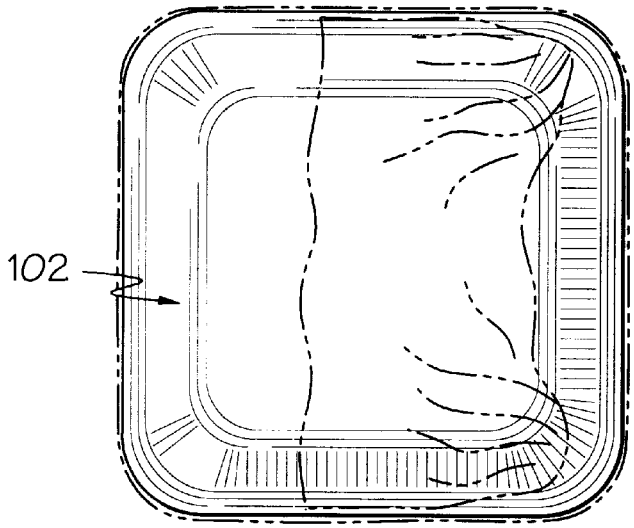
FIG. 19 is a plan view of the bottom of the package of FIG. 18.

Accordingly, when a package having a small width is measured at the package entryway 110 and the gripper 112 has begun traveling towards the film feeding apparatus 260 and film end pick-up position 114, slide solenoid 212 is not actuated and thus the slide 214 remains in the first, "closed" position with the bumpers 216 blocking the rearward travel path of plunger rod heads 222. Upon the gripper 112 returning to the predetermined stop position 117, plunger rod heads 222 contact bumpers 216 thereby releasing lateral elements 101 A, 101B of lower jaw 101, as shown in FIG. 8. With elements 101A and 101B no longer grasping the outer periphery of the film web, the stretching of this area is kept to a minimum during the folding process. However, when a package of normal or larger dimensions is measured at package entryway 110, the solenoid 212 is actuated and bumpers 216 do not impede the rearward travel path of plunger rod heads 222. Thus, the coupling of elements 101A, 101B and 101C is maintained and all elements simultaneously release the film web when solenoid 210 is deactuated. Thus, when wrapping smaller packages, tails 105, such as those created by prior art packaging machines and shown in FIGS. 16 and 17, are not formed underneath the finished package 102. Instead, the package 102 wrapped by the package wrapping machine of the present invention is folded having most of the film tucked underneath the package creating a good seal for the contents wrapped therein, as shown in FIGS. 18 and 19. Other methods for releasing individual gripper lateral elements 101A and 101B, such as individual solenoids or servos, as well as gripper combinations having jaws which translate, rather than pivot, with respect to each other would be apparent to one of ordinary skill in the art and accordingly are considered within the scope of the invention.

As shown in FIG. 2, the film drawn into the machine 100 is ultimately severed at a cut line by cutter means preferably comprising a serrated knife 124. Knife 124 is timed to function at the time the bar 127 has reached its lowermost position and has advanced the tail end of the film to the extent called for by the sensed package length. This is accomplished by actuating solenoid 204 to rapidly urge lever 200 to cause the knife to cut the film. The film is then folded under the package 102 by a rear underfolder 126 and by side underfolders 128 which are activated in synchronism with the rear underfolder 126, as best shown in FIG. 3. The general operation of the rear underfolder 126 and the side underfolders 128 are well known in the art and fully described in U.S. Pat. No. 4,510,731.

Sufficient film is required for the film to be underfolded in an overlapping fashion on the bottoms of packages such that the packages can be heat-sealed. In the case of packages which have a short length, the serrated knife 124 severs the film immediately prior to engagement of the film by the rear underfolder 126 since sufficient film has already been drawn into the machine 100 to properly overlap on the bottom of the package. In the case of packages which are greater in length, the vertically moving horizontal bar 127 is moved into contact with the film to pull a length of additional film from the film source. The film will then be severed from the continuous source of film and the rear underfolder 126 will then engage the drawn film and start underfolding the rear of the film. In this way, complete overlapping of the underfolded film on the bottom packages will be provided. The package 102 with a film section thus drawn and underfolded on three sides pushed out of the wrapping station 106 by a package pusher 130, shown in FIG. 3 in dotted lines as it contacts a package to move it leftwardly in an outfeed direction. What was formerly the trailing registered package edge now becomes the leading package edge in relation to its direction of travel.

As the package 102 is pushed from the wrapping station 106 by a second package pusher 130, the solenoid 210 is deactuated and the originally-gripped free end of film is released by the film gripper 112 and folded under the package 102 in known fashion by a second conveyor means for carrying the package 102 from the wrapping station 106 to a weighing station 134. In the illustrated embodiment, the second conveyor means comprises a heat-sealing conveyor 132 and the weighing station 134 comprises a scale 136 as shown in U.S. Pat. No. 4,813,211.

While the form of the apparatus herein described constitutes a preferred embodiment of the invention, it is to be understood that the invention is not limited to this precise form of apparatus, and that changes may be made therein without departing from the scope of the invention.

What is claimed is:

1. For use in gripping and paying-out film in an apparatus for wrapping packages of varying sizes a gripper assembly comprising:

a gripper, mounted for reciprocation between a film pick-up position and a stop position, said gripper having a first jaw and a second jaw which move between a closed film gripping position and an open film releasing position, at least one of said first and second jaws including a central jaw element and at least two lateral jaw elements which can be released separately from said central jaw element wherein said lateral elements are releasably coupled to said central jaw element;

an actuator for opening and closing said first and second jaws; and a selector for selectively releasing said lateral jaw elements of said gripper to release a lateral section of said film based on a premeasured package parameter.

2. The gripper assembly of claim 1 further comprising:

at least one plunger rod bracket mounted to said central element for supporting a plunger rod;

a plunger rod including a retainer, a head positioned on a trailing edge thereof, and a stop formed on a leading edge thereof;

a resilient member for biasing said plunger rod to a first position wherein said stop engages said plunger rod bracket;

a finger integrally attached to each of said lateral elements extending towards said central element positioned to engage a bottom surface of said retainer;

wherein when said finger engages said retainer, said lateral element and said central element are coupled for unitary movement.

3. The gripper assembly of claim 2 further comprising a slide bracket mounted behind said gripper stop position for slidably receiving a slide having bumpers positioned thereon so that when said slide is in a first closed position said bumpers block rearward travel of said plunger rod heads causing uncoupling of said lateral elements from said central element and when said slide is in a second open position rearward travel of said plunger rod heads is unimpeded.

4. The gripper assembly of claim 3 further comprising at least one resilient member for biasing said slide to said second open position.

5. The gripper assembly of claim 1 wherein said actuator is a solenoid.

6. The gripper assembly of claim 1 wherein said actuator includes a number of solenoids or servos corresponding to each lateral jaw element for separately opening and closing each individual jaw element.

7. The gripper assembly of claim 1 further comprising:

at least one plunger rod bracket mounted to said central element for supporting a plunger rod;

a plunger rod including a retainer, a head positioned on a trailing edge thereof, and a stop formed on a leading edge thereof;

a resilient member for biasing said plunger rod to a first position wherein said stop engages said plunger rod bracket;

a finger integrally attached to each of said lateral elements extending towards said central element positioned to engage a bottom surface of said retainer;

wherein when said finger engages said retainer, said lateral element and said central element are coupled for unitary movement.

8. The gripper assembly of claim 7 further comprising a slide bracket mounted behind said gripper stop position for slidably receiving a slide having bumpers positioned thereon so that when said slide is in a first closed position said bumpers block rearward travel of said plunger rod heads causing uncoupling of said lateral elements from said central element and when said slide is in a second open position rearward travel of said plunger rod heads is unimpeded.

9. The gripper assembly of claim 8 further comprising at least one resilient member for biasing said slide to said second open position.

10. For use in gripping and paying-out film in an apparatus for wrapping packages of varying sizes, a gripper assembly comprising:

a gripper, mounted for reciprocation between a film pick-up position and a stop position, said gripper having a first jaw and a second jaw which move between a closed film gripping position and an open film releasing position, at least one of said first and second jaws including a central jaw element and at least two lateral jaw elements which can be released separately from said central jaw element;

an actuator for opening and closing said first and second jaws; and a selector for selectively releasing said lateral jaw elements of said gripper to release a lateral section of said film based on a premeasured package parameter wherein said lateral jaw elements are coupled to said central jaw elements by a translatable catch which translates between a first position in which said lateral elements are coupled for unitary movement to said central element and a second position in which said lateral elements are not coupled to said central element.

11. The gripper assembly of claim 10 wherein said translatable catch is resiliently biased to said first position.

12. The gripper assembly of claim 11 further comprising a slide having bumpers mounted thereon which reciprocates between a non-contacting position in which said translatable catch does not uncouple said lateral elements from said central element and a contacting position in which said translatable catch uncouples said lateral elements from said central element.

* * * * *

Disclaimer 6,170,236—Michael A. Whitby; Philip Anthony Ratermann, both of Miami, OH. PACKAGE WRAPPING METHOD AND MACHINE. Patent dated January 9, 2001. Disclaimer filed February 16, 2001, by the assignee, Premark FEG L.L.C.

Hereby enters this disclaimer to claims 7, 8 and 9 of said patent.

*(Official Gazette, June 12, 2001)*